US009172128B2

(12) United States Patent
O. Horth et al.

(10) Patent No.: US 9,172,128 B2
(45) Date of Patent: Oct. 27, 2015

(54) ANTENNA POINTING SYSTEM

(71) Applicants: Richard O. Horth, Kirkland (CA); Marc-André Godin, Montréal (CA)

(72) Inventors: Richard O. Horth, Kirkland (CA); Marc-André Godin, Montréal (CA)

(73) Assignee: MacDonald, Dettwiler and Associates Corporation, Ste-Anne-de-Bellevue, Quebec (CA)

( * ) Notice: Subject to any disclaimer, the term of this patent is extended or adjusted under 35 U.S.C. 154(b) by 390 days.

(21) Appl. No.: 13/723,844

(22) Filed: Dec. 21, 2012

(65) Prior Publication Data

US 2014/0174214 A1 Jun. 26, 2014

Related U.S. Application Data

(60) Provisional application No. 61/630,985, filed on Dec. 23, 2011.

(51) Int. Cl.

| | |
|---|---|
| ***H01Q 3/00*** | (2006.01) |
| ***H01Q 1/12*** | (2006.01) |
| ***H01Q 1/28*** | (2006.01) |
| ***H01Q 3/08*** | (2006.01) |

(52) U.S. Cl.
CPC ..... *H01Q 1/125* (2013.01); *H01Q 1/288* (2013.01); *H01Q 3/08* (2013.01); *Y10T 74/18056* (2015.01)

(58) Field of Classification Search
CPC ..... H01Q 1/12; H01Q 1/125
USPC ..... 74/20, 21, 25, 47; 343/757, 758, 761, 343/763, 766
See application file for complete search history.

(56) References Cited

U.S. PATENT DOCUMENTS

| | | | | |
|---|---|---|---|---|
| 3,262,321 | A * | 7/1966 | Moul, Jr. | 74/1 R |
| 4,251,819 | A * | 2/1981 | Vickland | 343/882 |
| 5,945,961 | A * | 8/1999 | Price et al. | 343/757 |
| 5,999,139 | A * | 12/1999 | Benjamin et al. | 343/765 |
| 2012/0119973 | A1 * | 5/2012 | Ahring et al. | 343/882 |

* cited by examiner

*Primary Examiner* — Justin Krause
(74) *Attorney, Agent, or Firm* — Equinox IP; Franz Bonsang

(57) ABSTRACT

An antenna pointing system for selectively moving a payload relative to a mounting surface includes at least one rotary actuator having a moving part movable relative to a fixed part mounted on the surface. A connecting rod movably connects to the moving part and to the payload. A flexible mounting structure movably attaches the payload to the mounting surface.

8 Claims, 5 Drawing Sheets

ANTENNA POINTING SYSTEM

CROSS-REFERENCE TO RELATED APPLICATIONS

This application claims priority of U.S. Provisional Application for Patent No. 61/630,985 filed Dec. 23, 2011, the content of which is incorporated herein by reference in its entirety.

FIELD OF THE INVENTION

The present invention relates to the field of antenna systems, and is more particularly concerned with pointing systems for steerable antennas.

BACKGROUND OF THE INVENTION

It is well known in the art to use steerable (or tracking) antennas to communicate with a relatively moving target over a scan angle. Especially in the aerospace industry when the antenna is on board of a spacecraft, such steerable RF (Radio Frequency signal) antennas preferably need to have precise pointing, high gain, low mass, and high reliability.

Satellites often contain two (2) degree of freedom pointing devices to communicate, sense, etc. with other satellites or bodies. Since the distances are large, the pointing accuracy and resolution is critical.

The payload of these pointing devices is variable. Some payloads are full antennas, portions of an antenna, sensors, etc.

Many different pointing devices have been devised in the past. The simplest one being two rotary actuators (RA) assembled in a sequential chain and holding the payload, such as a reflector, as shown in FIGS. 1*a* and 1*b*. Especially when relatively small scan angles are required, such as below +/−30 degrees for example, these types of pointing devices have many disadvantages, or at least a few, among the following list:

high profile;
heavy mass, structurally inefficient;
high cost;
low accuracy;
low resolution;
low reliability;
need for Hold down and Release Mechanisms (HRM);
requires fixed predetermined stowed position for launch;
need for moving harness (RF rotary joint, electrical wiring, etc.); and/or
reduced RF performance in the case of a reflector pointing mechanism, Accordingly, there is a need for an improved antenna pointing system.

SUMMARY OF THE INVENTION

It is therefore a general object of the present invention to provide an improved antenna pointing system.

Advantages of the antenna pointing system of the present invention are:

1. lower profile;
2. lower mass, structurally efficient;
3. lower cost;
4. higher accuracy;
5. higher resolution;
6. higher reliability;

7. eliminates need for Hold down and Release Mechanisms (HRM);
8. allows for last minute selection of stowed position for launch;
9. eliminated need for moving harness (RF rotary joint, electrical wiring, etc.); and/or
10. improved RF performance in the case of a reflector pointing mechanism.

The above first three (3) points are main advantages when using rotary actuators.

According to an aspect of the present invention there is provided an antenna pointing system for selectively moving a payload relative to a mounting surface, said system comprising:

at least one rotary actuator having a moving part being movable relative to a fixed part adapted for mounting on the surface;

a connecting rod movably connecting to the moving part at a first end thereof and adapted for movably connecting to the payload at a second end thereof; and a flexible mounting structure for movably attaching the payload to the mounting surface.

Conveniently, the flexible mounting structure is a universal joint, including bearings, flexures or the like, preferably located near a geometric center of the payload.

In one embodiment, there are two rotary actuators with essentially the two second ends of the connecting rods connecting adjacent a perimeter of the payload, the two actuators being angularly spaced from one another relative to a rotation center of the flexible mounting structure, typically by an angle sufficient to make use of the full angular displacement range of the payload about the flexible mounting structure.

In one embodiment, there are first and second rotary actuators connecting to respective said connecting rod with said second ends of said connecting rods movably connecting to corresponding first and second attachment points of the payload.

Typically, the first and second attachment points are angularly spaced from one another relative to a rotation center of the flexible mounting structure, and the first and second attachment points are substantially adjacent a perimeter of the payload.

Conveniently, the first and second attachment points are substantially 90 degrees apart from one another relative to the rotation center of the flexible mounting structure.

Other objects and advantages of the present invention will become apparent from a careful reading of the detailed description provided herein, within appropriate reference to the accompanying drawings.

BRIEF DESCRIPTION OF THE DRAWINGS

In the annexed drawings, like reference characters indicate like elements throughout.

DETAILED DESCRIPTION OF THE INVENTION

With reference to the annexed drawings the preferred embodiments of the present invention will be herein described for indicative purpose and by no means as of limitation.

Figure 1B:
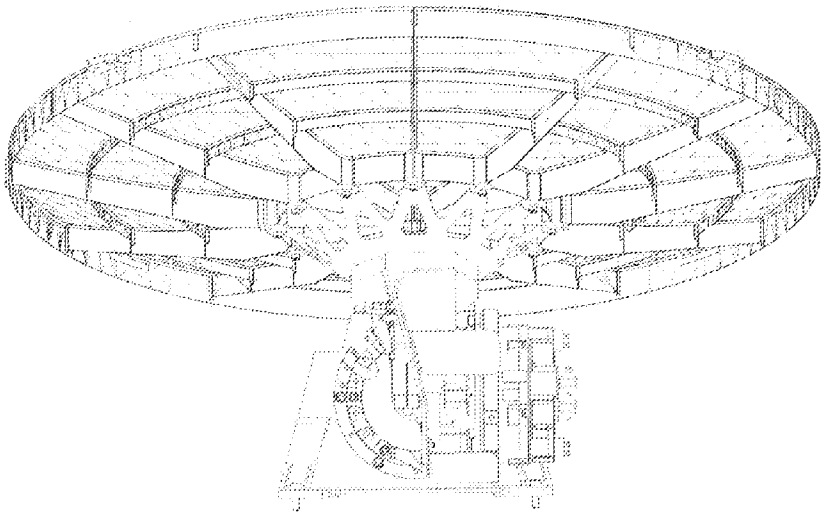
FIG.1b (PRIOR ART)
FIGS. 1*a* and 1*b* are side and rear elevation views, respectively, of an antenna reflector mounted with a prior art two-axis gimbal pointing system.
Figure 1A:
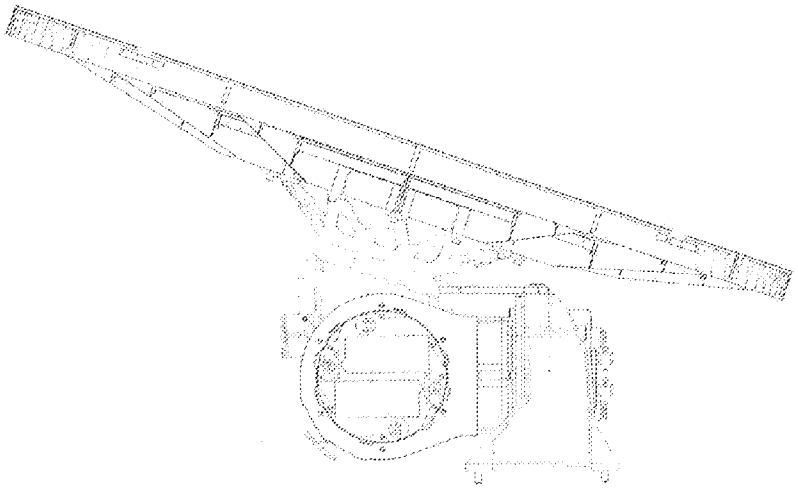
FIG.1a (PRIOR ART)
Figure 2:
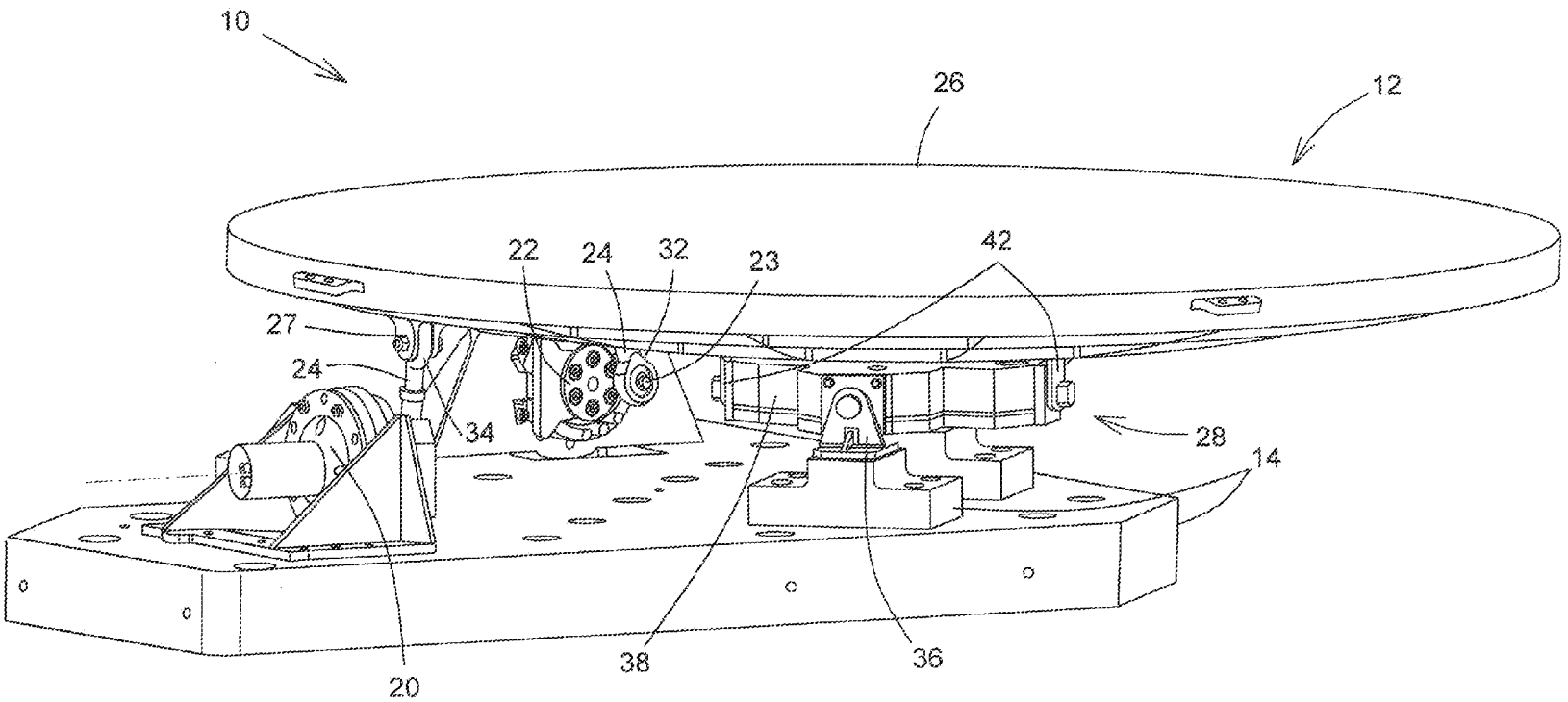
FIG. 2 is a top perspective view of an embodiment of an antenna pointing system in accordance with the present invention movably supporting an antenna reflector payload.
Figure 3:
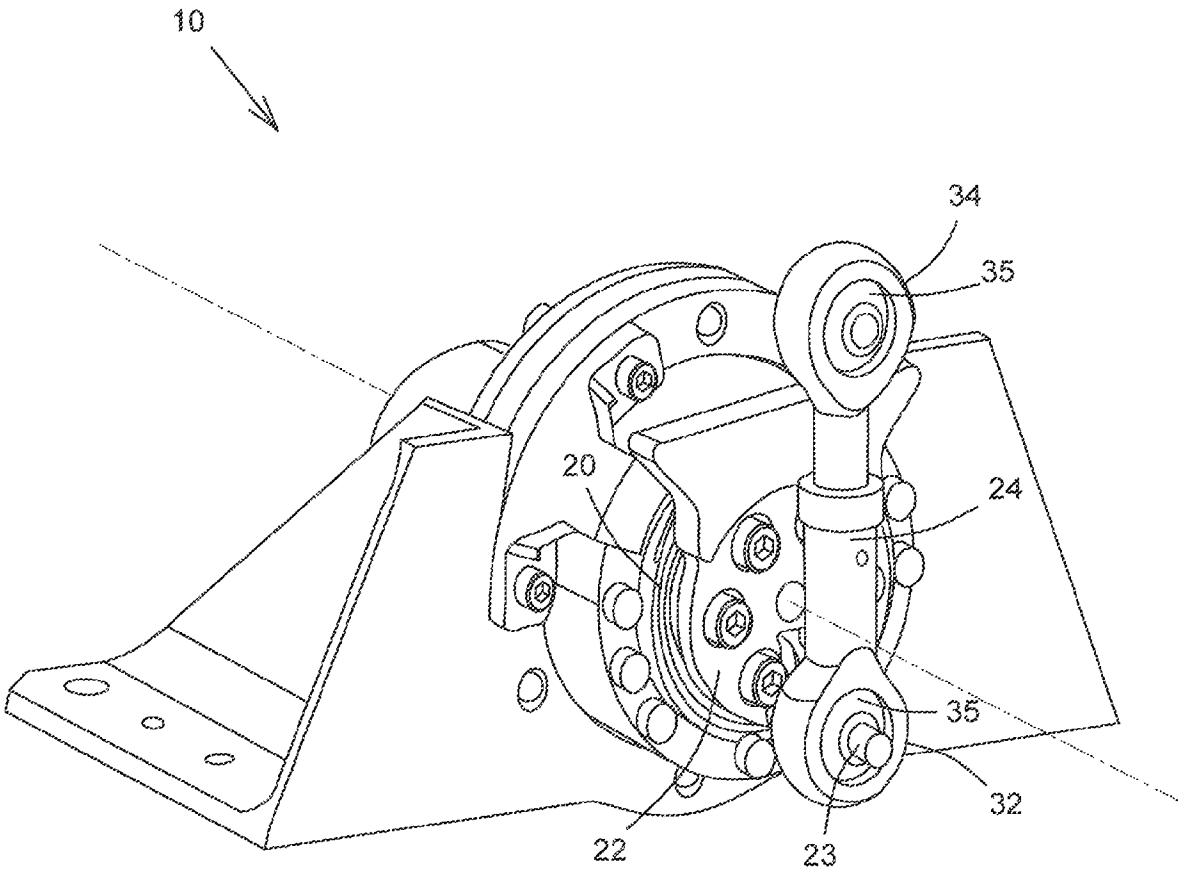
FIG. 3 is an enlarged top perspective view of a rotary actuator of the embodiment of FIG. 2.

Referring to FIGS. 2 and 3, there is shown a schematic diagram of an embodiment of the low profile high resolution and torque antenna pointing system 10. In the case presented, the pointing system 10 points a reflector, part of an RF (Radio Frequency signal) antenna 12 mounted on board of a spacecraft, represented by the mounting surface 14 situated in orbit. The pointing system 10 consists of using rotary actuators 20 in conjunction with cranks 22 and connecting rods 24 to impart rotations to a payload structure 26, such as an antenna reflector assembly, which is movably held in place by a flexible mounting structure 28 as a universal joint structure or the like. An example of the complete system 10 is shown in FIG. 2.

In the embodiment 10, the RF performance is improved because the generally orthogonal first 30 and second 31 rotation axes of the universal joint 28 intersects a point proximate the geometric center of the reflector 26, to define the rotation center R thereof. The system 10 uses two rotary actuators 20 to drive two degrees of freedom. Both rotary actuators 20 have their fixed part secured to the base plate 14 eliminating any mobile harnessing, such as RF rotary joint, electrical wiring, etc. A crank 22 is assembled on the output of the moving part of both rotary actuators 20. A rotary actuator 20 with its crank 22 is shown in FIG. 3.

Figure 4:
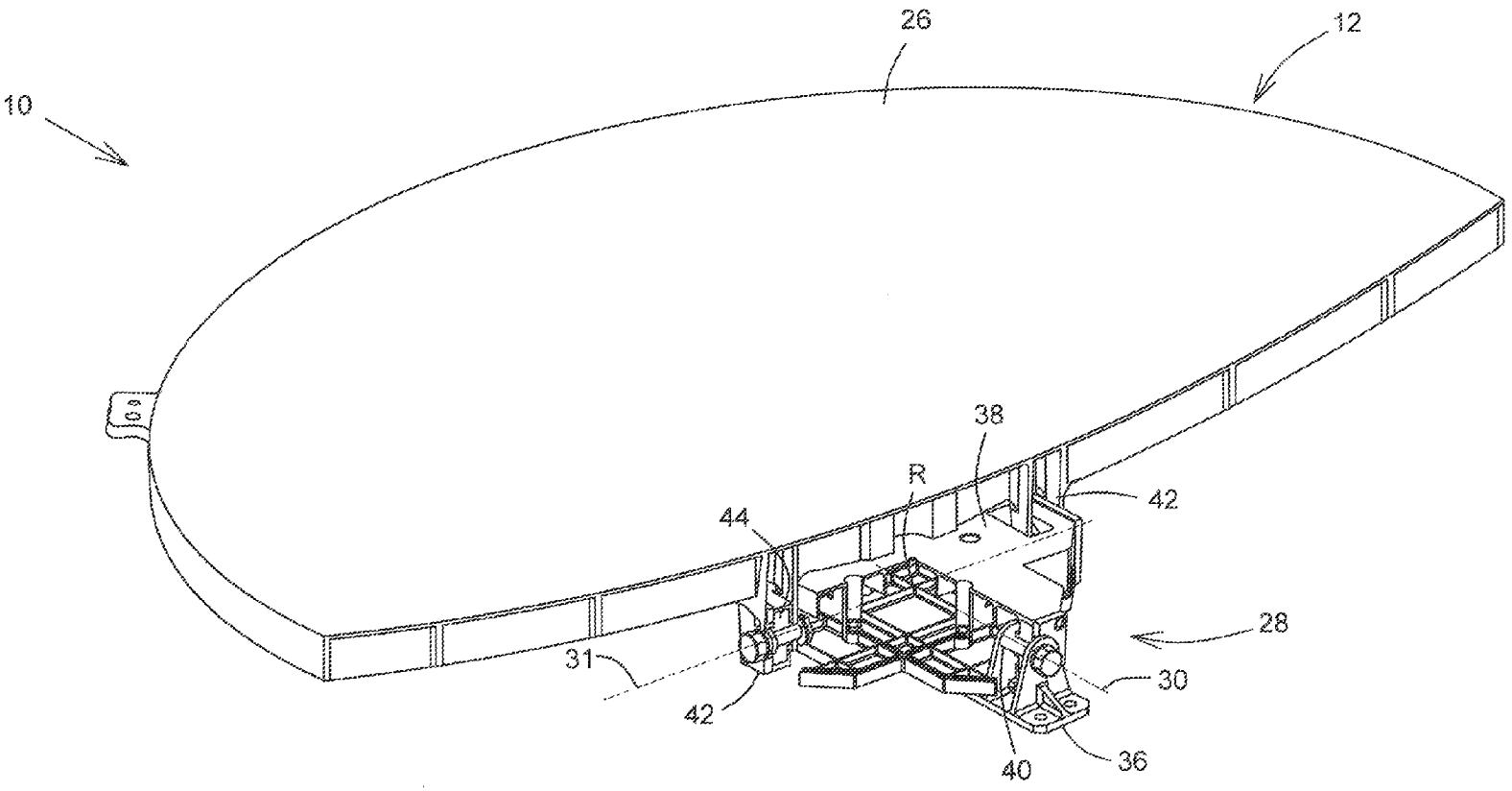
FIG. 4 is a partially broken enlarged top perspective view of a universal joint of the embodiment of FIG. 2.

An elongated connecting rod 24 has a first proximal end 32 movably connected to the shaft 23 of the crank 22 and the opposite second distal end 34 movably connected to the payload 26, at an attachment point 27 typically adjacent a perimeter thereof. Typically, both ends 32, 34 are connected through spherical bearings 35, flexures or the like in order to allow angular displacements thereof between respective connecting elements. The payload 26 is movably mounted on the surface 14 using the universal joint 28 typically consisting of one to two (1-2) static brackets 36 securable to the surface 14 and movably supporting a cross 38 about the first rotation axis 30 via at least one first bearing 40, flexure or the like, and one to two (1-2) moving brackets 42 extending from or secured to the payload 26 and movably supported by the cross 38 about the second rotation axis 31 via at least one second bearing 44, flexure or the like, as shown in FIG. 4.

Figure 5:
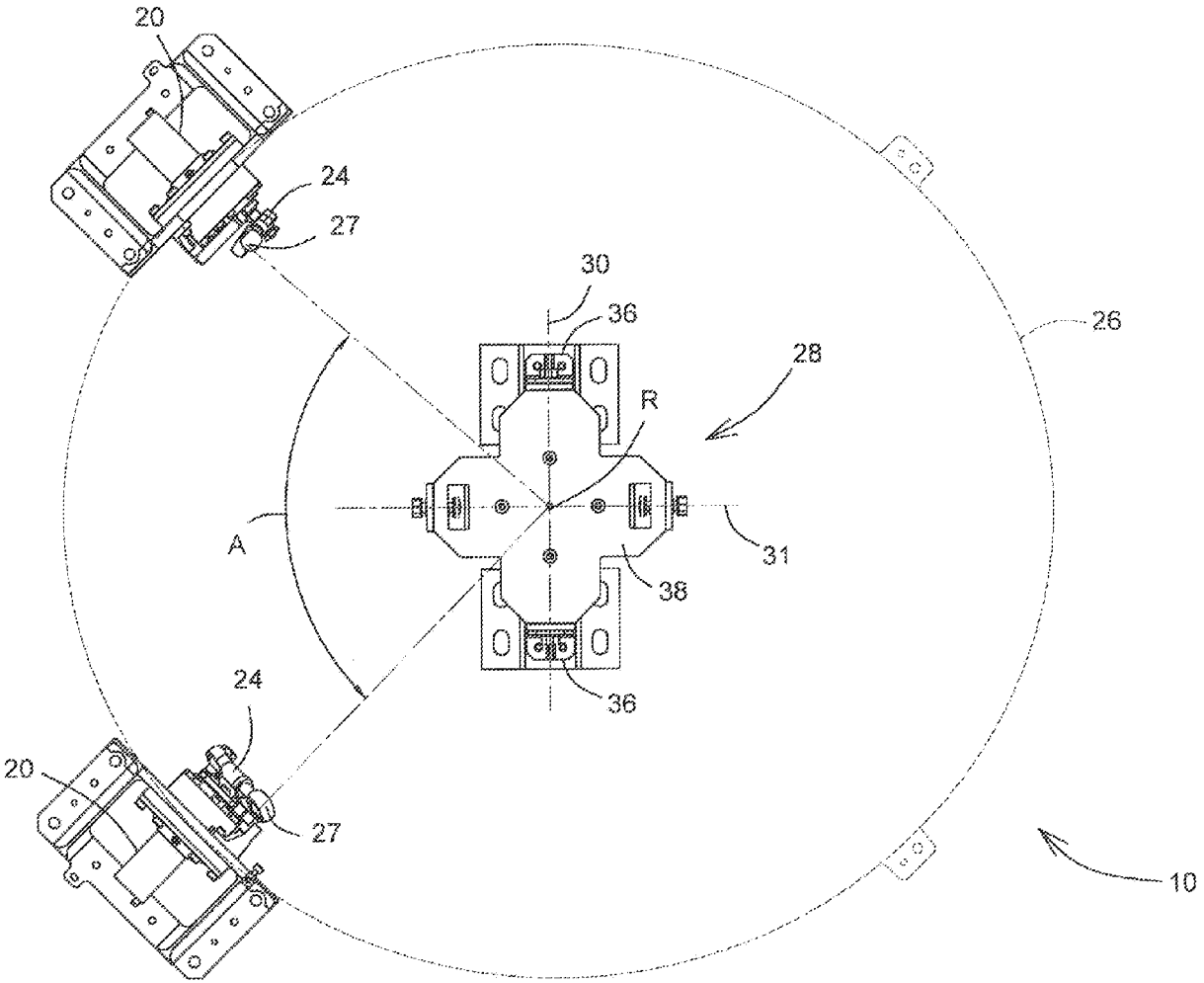
FIG. 5 is a partially broken top plan view of the embodiment of FIG. 2.

As best seen in FIG. 5, the two attachment points 27 connecting to the two second distal ends 34 of the respective connecting rods 24 are typically angularly spaced from one another relative to the rotation center R of the flexible mounting structure 28, as illustrated by angle A. Angle A is typically sufficient to make use of the full angular displacement range of the payload 26 about the flexible mounting structure 28. To this end, angle A is preferably around 90 degrees.

Although the antenna pointing system has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. An antenna pointing system for selectively moving a payload relative to a mounting surface, said system comprising:

at least one rotary actuator having a moving part being rotatably movable relative to a fixed part adapted for mounting on the surface, the moving part supporting a crank;

a connecting rod movably connecting to the crank at a first end thereof and adapted for movably connecting to the payload at a second end thereof, the first and second ends of the connecting rod being angularly displaceable in all directions relative to the crank and the payload respectively; and a flexible mounting structure for movably attaching the payload to the mounting surface.

2. The antenna pointing system of claim 1, wherein the at least one rotary actuator includes first and second rotary actuators connecting to respective said connecting rod with said second ends of said connecting rods movably connecting to corresponding first and second attachment points of the payload.

3. The antenna pointing system of claim 2, wherein the first and second attachment points are angularly spaced from one another relative to a rotation center of the flexible mounting structure.

4. The antenna pointing system of claim 3, wherein the first and second attachment points are substantially adjacent a perimeter of the payload.

5. The antenna pointing system of claim 2, wherein the first and second attachment points are substantially 90 degrees apart from one another relative to the rotation center of the flexible mounting structure.

6. The antenna pointing system of claim 1, wherein the flexible mounting structure is located adjacent a geometric center of the payload.

7. The antenna pointing system of claim 1, wherein the flexible mounting structure is a universal joint structure.

8. The antenna pointing system of claim 1, wherein the first and second ends of the connecting rod are angularly displaceable relative to the crank and the payload via a respective spherical bearing.

* * * * *